United States Patent [19]

Uno et al.

[11] 4,448,121

[45] May 15, 1984

[54] ROTARY PRINTING PRESS AND INSPECTION METHOD AND APPARATUS THEREFOR

[75] Inventors: Chiyomatsu Uno, Saitama; Hiroshi Muto, Chiba, both of Japan

[73] Assignee: Komori Printing Machinery Co., Ltd., Japan

[21] Appl. No.: 380,508

[22] Filed: May 21, 1982

[30] Foreign Application Priority Data

Jun. 13, 1981 [JP] Japan ..... 56-91363

[51] Int. Cl.[3] ..... B07C 5/34

[52] U.S. Cl. ..... 101/76; 101/2; 101/234; 101/240; 101/426; 209/552; 209/583

[58] Field of Search ..... 101/76, 77, 183, 184, 101/232, 233, 234, 240, 2, 426; 209/583, 552, 584, 900

[56] References Cited

U.S. PATENT DOCUMENTS

| | | | |
|---|---|---|---|
| 3,191,526 | 6/1965 | Ross | 101/76 X |
| 3,527,164 | 9/1970 | Bulk et al. | 101/184 X |
| 4,044,666 | 8/1977 | Doucet | 101/76 |
| 4,210,078 | 7/1980 | Greiner et al. | 101/183 X |
| 4,306,496 | 12/1981 | Charbonneau et al. | 101/76 |
| 4,358,016 | 11/1982 | Richardson et al. | 209/583 X |

*Primary Examiner*—Clifford D. Crowder

*Attorney, Agent, or Firm*—Remy J. VanOphem

[57] ABSTRACT

A rotary printing press assembly includes an inspection apparatus interposed between a sheet feeder for feeding printed sheets and a rotary printing press having a printing cylinder for printing additional indicia on the printed sheets. The inspection apparatus has a pair of inspection cylinders rotatable in opposite directions. A printed sheet is supplied from the sheet feeder and is held at its face and back against peripheral surfaces of the inspection. Detectors are disposed in confronting relationship to the peripheral surface of the inspection surface cylinders for inspecting the printed sheet on the inspection cylinders for any defect and for generating signals in response to detection of any defect on the printed sheet. The printing cylinder is movable away from an operational position adjacent an impression cylinder to an inoperational position away therefrom in response to a signal from the detectors indicating a defective sheet. The printed sheet bearing the detected defect passes unprinted between the printing and impression cylinders and the defective printed sheet is discharged.

17 Claims, 3 Drawing Figures

ROTARY PRINTING PRESS AND INSPECTION METHOD AND APPARATUS THEREFOR

BACKGROUND OF THE INVENTION

The present invention relates to a rotary printing press for additional printing, for example, of serial numbers, the press having an inspection apparatus for checking printed products for acceptability prior to additional printing operations.

To meet a wide variety of printing requirements in recent years, there has been an increasing demand for printed products or sheets which include images or patterns previously printed and various additional marks or indicia such as serial numbers, seals and stamps, store names and management codes, that are subsequently printed. Such printed products are often produced successively by a printing press for printing images and another printing press coupled therewith for printing marks or numbers. Alternatively, products on which images have been printed are supplied to an independent printing press for the printing of indicia or other additional information. Printed sheets which require such additional printing include bank bills, securities and fancy art prints that are individually important or expensive. These are printed in separate processes for printing patterns and for printing additional marks, numbers or characters, respectively. The prints on which patterns have been printed are checked for defects prior to the additional printing operation. Only those prints which have an accepted quality of printed images are allowed to go to press for additional printing, thus avoiding the production of defective printed products. Those printed products which need to be serially numbered with no missing number allowed, such as bank bills, are required to undergo a stringent inspection for any flaws before other marking are additionally printed on the prints. The conventional inspection and selection practice has relied on checking apparatus installed in a wide area and attended by inspectors for visual inspection. In order to enable the inspection process to keep up with the high-speed printing operation, a large number of skilled inspectors would be required, an expensive prospect which would lead to many problems.

Recent progress in electronics and optical equipment has resulted in the development of an apparatus for electrically detecting non-printed sheets, sheets printed out of registry, doubling, improper and uneven print densities, and other defects through an optical system, and for producing electrical output signals indicative of whether printed products inspected are acceptable or not, such inspection occurring at speeds comparable to high speeds of operation of printing presses. Since the inspection process is carried out independently of the printing process, however, the above described apparatus still requires a large amount of manpower to take care of the inspection process, to deliver the printed sheets from the printing press for printing patterns to the inspection apparatus, to deliver the printed sheets from the inspection apparatus to an additional printing press, and to stack them in place. Therefore, the prior art inspection apparatus does not save labor and, hence, reduce the cost of printing, and cannot be operated to full advantage.

SUMMARY OF THE INVENTION

It is a primary object of the present invention to provide a rotary printing press assembly having an inspection apparatus for inspecting printed products during an additional printing process and for discharging defective printed products.

Another object of the present invention is to provide a rotary printing press assembly having a checking apparatus which requires no manpower for delivering and stacking printed sheets for inspection and, hence, which provides labor and cost savings.

Still another object of the present invention is to provide a rotary printing press assembly having a checking apparatus which occupies only a small amount of space.

The present invention provides a rotary printing press assembly including a rotary printing press having a printing cylinder for printing additional indicia on printed sheets, a sheet feeder for feeding the printed sheets to the printing cylinder, and an inspection apparatus is interposed between the rotary printing press and the sheet feeder. The inspection apparatus has a pair of inspection cylinders rotatable in opposite directions with a printed sheet, as supplied from the sheet feeder, being held at its face and back against peripheral portions of the inspection cylinders, respectively, detectors are disposed in confronting relation to the peripheral portions of the inspection cylinders, respectively, for inspecting the printed sheet on the inspection cylinders for any defect and for generating signals in response to detection of any defect on the printed sheet. The printing cylinder is displaced from an operational position in response to a signal from the detectors indicating the detection of a defect for discharging the printed sheet bearing the detected defect.

These and many other objects, features, and advantages of the present invention will become more apparent from the following description when taken in conjunction with the accompanying drawings in which the preferred embodiment of the present invention is shown by way of illustrative example.

DESCRIPTION OF THE PREFERRED EMBODIMENT

Figure 1:
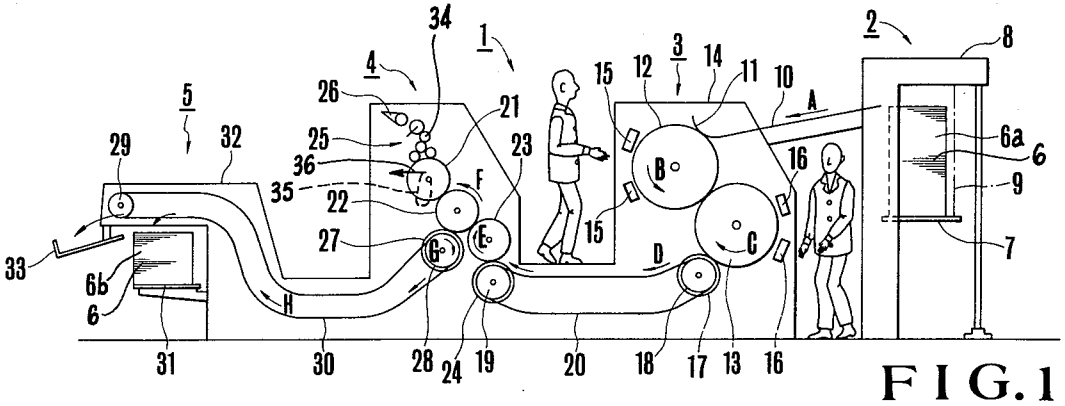
FIG. 1 is a schematic side elevational view of a rotary printing press assembly including inspection apparatus according to the present invention.

As shown in FIG. 1, a rotary printing press assembly 1 according to the present invention includes a sheet feeder 2, an inspection apparatus 3, a rotary printing press 4, a sheet discharging unit 5, and other accessories. The illustrated rotary printing press assembly 1 serves to print serial numbers on bills on which images or patterns have already been printed.

The sheet feeder 2 includes a stacker table 7 for supporting thereon an input stack *6a* of sheets 6. A plurality of bill patterns have been printed on each of the stacks 6. The stacker table 7 is kept suspended by chains 9 from a sheet feeder frame 8 and is automatically movable intermittently stepwise upwardly as sheets 6 at upper layers of the input stack 6a are picked up and fed, one by one, by a suction device, not shown, mounted on the top of the sheet feeder frame 8. Between the sheet feeder 2 and the inspection apparatus 3, there are disposed a feed table 10 and a swing gripper assembly. The feed table 10 receives sheets 6 fed from the sheet feeder 2 in the direction fo the arrow A. The swing gripper assembly 11 sequentially supplies the sheets 6, which have been fed onto the feed table 10, into the inspection apparatus 3.

The inspection apparatus 3 includes a first inspection cylinder 12 and a second inspection cylinder 13. Each of the first and second inspection cylinders 12 and 13 are supported between lateral opposite side members of a frame 14 for rotation about their own axes in opposite directions, as indicated by the arrows B and C, respectively. The first and second inspection cylinders 12 and 13 are parallel to each other and have mutually engaging peripheral cylindrical surfaces. Each of the inspection cylinders 12 and 13 has a diameter which is twice the diameter of a printing cylinder 21, described later, of the rotary printing press 4.

Each of the first and second inspection cylinders 12 and 13 has peripheral grooves and a pair of finger grippers provided therein, as is well known in the art. The finger grippers grip a sheet 6, as it is supplied by a gripper from the swing gripper assembly 11 and wound around the periphery of the first or second inspection cylinder 12 or 13. When the sheet 6 is wound around the first inspection cylinder 12, the sheet 6 has its face directed outwardly of the cylinder and in a forward direction. When the sheet 6 is wound around the second inspection cylinder 13, the sheet 6 has its back directed outwardly of the cylinder and in a rearward direction.

Inspection mechanisms in the form of pairs of detectors 15 and 16 are disposed in confronting relation to the peripheral surfaces of the first and second inspection cylinders 12 and 13, respectively. The detectors 15 and 16 serve to detect any defect on the sheet 6 carried on the first and second inspection cylinders 12 and 13 associated therewith and to produce signals upon detection of any defect on the sheet 6.

A receiving cylinder 17 is held against the second inspection cylinder 13 and has a diameter which is half as large as the diameter of each of the first and second inspection cylinders 12 and 13. A pair of endless delivery chains 20 is trained around a sprocket 18 mounted coaxially with the receiving cylinder 17 and a sprocket 19 rotatably mounted in a lower portion of the rotary printing press 4. Although not shown, a plurality of gripper shafts, well known in the art, are supported at predetermined spaced intervals between the pair of endless delivery chains 20. Each gripper shaft has a plurality of grippers which coact with the receiving cylinder 17 to receive the sheet 6 from the second inspection cylinder 13 and also feed the received sheet 6 in the direction of the arrow D as the endless delivery chains 20 operate.

The rotary printing press 4 includes the printing cylinder or plate cylinder 21 having on its periphery serial-number printers, not shown, an impression cylinder 22 held against the printing cylinder 21 to impose a printing pressure on the sheet 6 during printing operation, a transfer cylinder 23 held aginst the impression cylinder 22, and a feeding cylinder 24 mounted coaxially with the sprocket 19 and held against the transfer cylinder 23. The impression cylinder 22 and the transfer cylinder 23 have peripheral grooves, not shown, and finger grippers also not shown, disposed in the peripheral grooves, for gripping the sheet 6 as it is transferred from the delivery chains 20 to the transfer cylinder 23 and from the transfer cylinder to the impression cylinder 22 in the directions of the arrows E and F.

Figure 3:
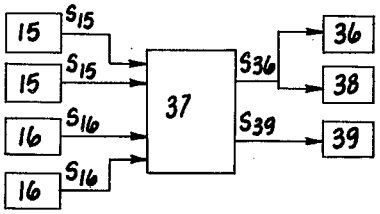
FIG. 3 is a block diagram illustrating the response of the rotary printing press assembly to the detection of a defective sheet.

The printing cylinder 21 is movably mounted to the printing press 4, as shown schematically at 35 into and out of an operational position, in which the printing cylinder 21 is held against the impression cylinder 22, by a first cam mechanism 36, shown schematically by an arrow in FIG. 1 and by a block in FIG. 3. The first cam mechanism 36 is located at the ends of the shaft of the printing cylinder 21. The first cam mechanism 36 is actuated in response to a signal from any of the detectors 15 and 16 upon detection of any flaw on the sheet 6. As shown in FIG. 3, signal processing means 37, such as a microprocessor, are provided to process the input signals received from the four detectors and generate an appropriate output signal to actuate the first cam mechanism 36. In response to the output signal, the first cam mechanism displaces the printing cylinder 21 away from the impression cylinder 22 when the particular sheet 6 bearing the detected defect passes by. After the particular defective sheet 6 has gone, the first cam mechanism 36 cause the printing cylinder 21 to return to engagement with the impression cylinder 22.

The serial-number printers on the printing cylinder 21 are drivable by a number shifting mechanism 38, shown only by a block in FIG. 3, but well known in the art, disposed at one end of the shaft of the printing cylinder 21 for shifting one number in the serial-number printers each time the printing cylinder 21 makes one revolution. Upon reception of a defect detection signal indicative of any flaw on the sheet 6 supplied from the detectors 15 and 16, the number shifting mechanism 38 stops the shifting of numbers temporarily while the defect-bearing sheet 6 passes by the printing cylinder 21. As with the first cam mechanism 36, a signal processing means, which may consist of the same signal processing means 37 described above, is provided between the detectors 15 and 16 and the number shifting mechanism 38 to provide for a proper response of the number shifting mechanism to the detection of an error.

The rotary printing press 4 further includes an ink supply device 25 including an ink fountain 26 and a group of rollers 34 for supplying ink from the ink fountain 26 to the serial-number printers, as is well known in the art.

A delivery cylinder 27 is held against the impression cylinder 22. A pair of endless delivery chains 30 is trained around a sprocket 28 mounted coaxially with the delivery cylinder 27 and a sprocket 29 disposed at a rear end of the sheet discharging unit 5. Between the pair of delivery chains 30, there are supported a plurality of gripper shafts positioned at predetermined spaced intervals and each having a plurality of finger grippers. The gripper shafts sequentially receive the sheets 6 from the impression cylinder 22 in the direction of the arrow G, in coaction with the delivery cylinder 27, and feed the received sheets 6 in the direction of the arrow H, as the delivery chains 30 move.

The sheet discharging unit 5 includes a stacker table 31 movable upwardly and downwardly relative to a frame 32 for stacking thereon printed sheets 6 as they are released, one by one from the finger grippers on the delivery chains 30. The stacker table 31 is automatically movable downwardly as the number of sheets 6 in the input stack 6*b* increases. The sheet discharging unit 5 also includes a sheet receiver 33 disposed below the sprocket 29. A second cam mechanism 39, shown only by a block in FIG. 3, is provided for opening and closing the finger grippers on the delivery chains 30 and normally opens the finger grippers as the latter are located above the stacker table 31 to thereby release the sheet 6. When the detectors 15 and 16 generate a detection signal indicative of a defective sheet, the second cam mechanism 39 functions to open the finger grippers upon arrival of the defective sheet at the sprocket 29, thereby discharging the defective sheet onto the sheet receiver 33. Again, signal processing means, such as signal processing means 37, may be provided between the detectors 15 and 16 and the second cam mechanism 39.

Figure 2:
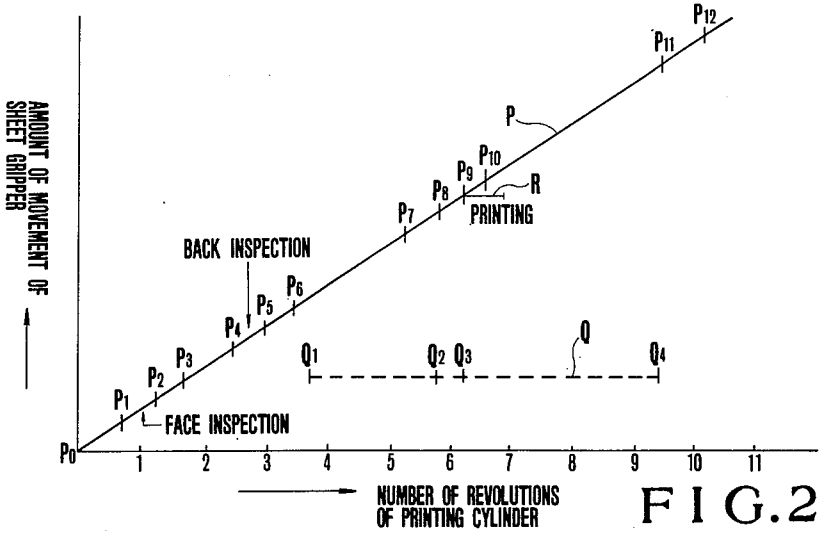
FIG. 2 is a graph showing a relationship between the number of revolutions of a printing cylinder and the amount of movement of a sheet gripper of the rotary printing press assembly of FIG. 1.

The operation of the rotary printing press assembly 1 thus constructed will now be described with reference to FIGS. 1 and 2. FIG. 2 is a graph including a horizontal coordinate axis which indicates the number of revolutions of the printing cylinder 21 and a vertical coordinate axis which indicates the amount of movement of a sheet gripper. A review of FIG. 2 shows that, as the number of revolutions of the printing cylinder 21 increases, the sheet gripper moves forward, as shown by the solid line P. The dotted line Q is indicative of a relationship between detection signals indicating a defective sheet, which are generated by the detectors 15 and 16, and the number of revolutions of the printing cylinder 21.

Sheets 6 stacked in the input stack 6*a* on the stacker table 7 are picked up one at a time by the suction device and delivered thereby onto the feed table 10 in the direction of the arrow A. The sheet 6 thus fed is then supplied onto the first inspection cylinder 12 by the swing gripper assembly 11. The finger grippers on the first inspection cylinder 12 start gripping the sheet 6 at the point $P_0$ in FIG. 2, the point $P_0$ serving as a starting point for rotation of the printing cylinder 21. Since the first and second inspection cylinders 12 and 13 are of a diameter twice that of the printing cylinder 21 and with the swing gripper assembly 11 and the receiving cylinder 17 being positioned as illustrated, the sheet 6 is transferred from the first inspection cylinder 12 to the second inspection cylinder 13 at the point $P_3$. At point $P_3$, the printing cylinder 21 has made about one and three-quarter revolutions. When the printing cylinder 21 has made approximately three and one half revolutions, indicated at $P_6$, the sheet 6 is transferred from the second inspection cylinder 13 to the delivery chains 20. Between the points $P_1$ and $P_2$, the face of the sheet 6 is inspected for defects by the detectors 15, and between the points $P_4$ and $P_5$, the back of the sheet 6 is inspected for defects by the detectors 16. The sheet 6 is transferred by the delivery chains 20 and is then gripped by the finger grippers on the transfer cylinder 23 at the point $P_7$. The sheet 6 is subsequently gripped by the finger grippers on the impression cylinder 22 at the point $P_8$. Additional serial numbers are printed on the sheet 6 during a time interval R starting at the point $P_9$. After the numbers have been printed, the sheet 6 is gripped by the finger grippers on the delivery chains 30 at the point $P_{10}$. The sheet 6 is then transferred by the delivery chains 30 and released from the finger grippers on the delivery chains 30 at the point $P_{11}$ so as to be placed onto the stacker table 31.

The rotary printing press assembly 1 operates in the manner as described above when the sheet 6 inspected has a pattern properly printed without defects. However, when a sheet 6 on which there are printing defects, such as doubled patterns, is supplied into the inspection apparatus 3, the detectors 15 and 16 detect such defects irrespective of whether they are on the face or back of the sheet 6, and generate a signal $S_{15}$ or $S_{16}$ (FIG. 3) indicative of the defective sheet at the point $Q_1$ (FIG. 2) immediately after the sheet 6 has been transferred onto the delivery chains 20. The signal $S_{15}$ or $S_{16}$ is detected by the signal processor 37 which generates control signals 36 and 39 in response thereto. An output signal $S_{36}$ is received by the first cam mechanism 36 for moving the printing cylinder 21 and the number shifting mechanism for the serial-number printers at the point $Q_2$ before the sheet 6 is transferred onto the impression cylinder 22 at the point $P_8$, so that the printing cylinder 21 is driven away from the impression cylinder 22. At the same time, the shifting of numbers in the serial-number printers is stopped. Therefore, no numbers are printed on the defective sheet 6 as the latter passes between the printing cylinder 21 and the impression cylinder 22. The defect-free sheets 6 which precede and follow the defective sheet 6 are serially numbered with no number missing. The printing cylinder 21 is returned to engagement with the impression cylinder 22 at the point $Q_3$. Then, the defective and defect-free sheets 6 are sequentially delivered to the delivery chain 30. The defect-free sheets 6 are discharged onto the stacker table 31. However, the output signal $S_{39}$ indicative of detection of the defective sheet 6 is received by the second cam mechanism 39 for opening and closing the finger grippers on the delivery chains 30 at the point $Q_4$ so as to open the finger grippers at the point $P_{12}$ rather than at the point $P_{11}$. At point $P_{12}$, the gripped end of the defective sheet 6 reaches the sprocket 29. Thus, the defective sheet 6 is sorted out from defect-free sheets 6 and is discharged onto the sheet receiver 33.

With the foregoing inspection and sorting operation, the sheet 6 is wound around the first and second inspection cylinders 12 and 13 which rotate in opposite directions, so that the sheet 6 can be thoroughly inspected for any flaw on its face and its back. Since the diameter of each of the first and second inspection cylinders 12 and 13 is twice the diameter of the printing cylinder 21, the area in which defects can be detected is relatively large. Furthermore the sheet 6, as carried on the first and second inspection cylinders 12 and 13, is curved less severely than would be the case with a smaller diameter cylinder, providing an arrangement which prevents the detectors 15 and 16 from malfunctioning. For the control, maintenance, and servicing of the inspection apparatus 3, the operator can enter between the sheet feeder 2 and the inspection apparatus 3 or between the latter and the rotary printing press 4, as illustrated in FIG. 1. Since the first and second inspection cylinders 12 and 13 each have a relatively large diameter, the operator can work in a comfortable position during controlling and servicing operations.

Although a specific preferred embodiment has been shown and described in detail, it should be understood that various changes and modifications may be made thereto without departing from the scope of the appended claims. For example, printed sheets that can be handled by the rotary printing press assembly of the present invention are not limited to bills, but may be securities, fancy art prints, or other printed sheet materials which need to be inspected for defects. In addition, the marks to be additionally printed may be seals, store names, or management codes other than numbers.

What is claimed is:

1. In a rotary printing press for sequentially printing additional indicia on preprinted sheets, said printing press having an impression cylinder, a printing cylinder disposed parallel to and in engagement with said impression cylinder and selectively movable out of engagement therewith, input sheet feeding means sequentially supplying preprinted sheets to said impression cylinder for printing, and output sheet feeding means sequentially removing said preprinted sheets from said impression cylinder, the improvement comprising:

automatic defect detection means for detecting defects on said preprinted sheets, said automatic defect detection means being disposed adjacent said input means such as to inspect said preprinted sheets as they are sequentially supplied to said impression cylinder;

printing cylinder moving means selectively operable to temporarily move said printing cylinder away from said impression cylinder in response to the detection of a defective preprinted sheet by said automatic defect detection means, such that said additional indicia is not printed on preprinted sheets on which a defect is detected; and sorting means disposed along said output means and responsive to the detection of defects in said preprinted sheets by said automatic defect detection means to sort said preprinted sheets into a first output stream of defective preprinted sheets and a second output stream of preprinted sheets on which no defect is detected.

2. The improvement of claim 1 wherein said printing press further comprises sequential printing means for printing different additional indicia on each of said preprinted sheets wherein said sequential printing means advances sequentially to print different additional indicia only after a preprinted sheet is printed and is not advanced when a preprinted sheet containing a defect is disposed within said printing cylinder but is not printed.

3. The improvement of claim 2 wherein said sequential printing means comprises a serial number printing means printing different serial numbers on each of said preprinted sheets.

4. The improvement of claim 3 wherein said automatic defect detection means further comprises:

at least one inspection cylinder, said preprinted sheets being sequentially supplied to, wrapped around and fed from said inspection cylinder; and at least one detector disposed adjacent to said inspection cylinder and generating a signal in response to the detection of a defect in said preprinted sheet wrapped around said inspection cylinder, said printing cylinder moving means and said sorting means being responsive to said signal.

5. The improvement of claim 4 wherein said defect detection means comprises two of said inspection cylinders mutually engaged with each other such that said preprinted sheet is fed from one inspection cylinder to the other and further comprising two of said detectors, one disposed adjacent to each of said inspection cylinders such that each of said detectors inspects one side of said preprinted sheets.

6. The improvement of claim 4 wherein the diameter of said inspection cylinder is equal to two times the diameter of said printing cylinder.

7. The improvement of claim 1 wherein said sorting means further comprises:

sheet moving means moving said preprinted sheets away from said output sheet feeding means;

sheet holding means releasably holding said preprinted sheets to said sheet moving means such that said defective preprinted sheets are released by said holding means at a first predetermined location along said sheet moving means and said preprinted sheets not having detected defects are released by said sheet holding means at a second predetermined location along said sheet moving means.

8. A rotary printing press assembly for adding additional indicia to preprinted sheets and sorting defective preprinted sheets from preprinted sheets having no detected defect, said rotary printing press assembly comprising:

frame means;

an impression cylinder rotatably interconnected with said frame means;

a printing cylinder rotatably and movably interconnected with said frame means and disposed parallel thereto and in engagement therewith, said printing cylinder being selectively movable out of engagement with said impression cylinder;

input sheet feeding means sequentially supplying preprinted sheets to said impression cylinder for printing;

output sheet feeding means sequentially removing said preprinted sheets from said impression cylinder;

automatic defect detection means for detecting defects on said preprinted sheets, said automatic defect detection means being disposed adjacent said input means such as to inspect said preprinted sheets as they are sequentially supplied to said impression cylinder;

printing cylinder moving means selectively operable to temporarily move said printing cylinder away from said impression cylinder in response to the detection of a defective preprinted sheet by said automatic defect detection means, such that said additional indicia is not printed on preprinted sheets on which a defect is detected; and sorting means disposed along said output means and responsive to the detection of defects in said preprinted sheet by said automatic defect detection means to sort said preprinted sheets into a first output stream of defective preprinted sheets and a second output stream of preprinted sheets on which no defect is detected.

9. The rotary printing press assembly of claim 8 wherein said printing press further comprises sequential printing means for printing different additional indicia on each of said preprinted sheets wherein said sequential printing means advances sequentially to print different additional indicia only after a preprinted sheet is printed and is not advanced when a preprinted sheet containing a defect is disposed within said printing cylinder but is not printed.

10. The rotary printing press assembly of claim 9 wherein said sequential printing means comprises a serial number printing means printing different serial numbers on each of said preprinted sheets.

11. The rotary printing press assembly of claim 8 wherein said automatic defect detection means further comprises:

at least one inspection cylinder, said preprinted sheets being sequentially supplied to, wrapped around and fed from said inspection cylinder; and at least one detector disposed adjacent to said inspection cylinder and generating a signal in response to the detection of a defect in said preprinted sheet wrapped around said inspection cylinder, said printing cylinder moving means and said sorting means being responsive to said signal.

12. The rotary printing press assembly of claim 11 wherein said defect detection means comprises two of said inspection cylinders mutually engaged with each other such that said preprinted sheet is fed from one inspection cylinder to the other and further comprising two of said detectors, one disposed adjacent to each of said inspection cylinders such that each of said detectors inspects one side of said preprinted sheets.

13. The rotary printing press assembly of claim 11 wherein the diameter of said inspection cylinder is equal to two times the diameter of said printing cylinder.

14. The rotary printing press assembly of claim 8 wherein sorting means further comprises:

sheet moving means moving said preprinted sheets away from said output sheet feeding means;

sheet holding means releasably holding said preprinted sheets to said sheet moving means such that said defective preprinted sheets are released by said holding means at a first predetermined location along said sheet moving means and said preprinted sheets not having detected defects are released by said sheet holding means at a second predetermined location along said sheet moving means.

15. A method of printing additional indicia on preprinted sheets, said method comprising the steps of:

sequentially supplying said preprinted sheets to an input sheet feeding means;

sequentially inspecting said preprinted sheets for defects and generating a signal in response to the detection of a defect such that said signal is indicative of a defective preprinted sheet;

sequentially feeding said preprinted sheets from said input sheet feeding means to printing means such that said additional indicia is printed on said preprinted sheets by said printing means;

selectively temporarily disabling said printing means in response to said signal such that said additional indicia is not printed on said defective preprinted sheets;

sequentially feeding said preprinted sheets from said printing means to sorting means; and sorting said preprinted sheets in said sorting means, in response to said signal, into a first stream of defective preprinted sheets and a second stream of preprinted sheets having no defects.

16. The method of claim 15 wherein said step of sequentially inspecting said preprinted sheets for defects further comprises sequentially inspecting both sides of said preprinted sheets for defects.

17. The method of claim 15 wherein said printing means comprises sequential printing means for printing different additional indicia on each of said preprinted sheets wherein said step of selectively temporarily disabling said printing means in response to said signal comprises selectively temporarily disabling said sequential printing means such that said sequential printing means is not advanced to provide different additional indicia when said additional indicia is not printed on a defective preprinted sheet.

* * * * *

UNITED STATES PATENT AND TRADEMARK OFFICE

CERTIFICATE OF CORRECTION

PATENT NO. : 4,448,121 Sheet 1 of 4

DATED : May 15, 1984

INVENTOR(S) : Uno, et al.

It is certified that error appears in the above-identified patent and that said Letters Patent is hereby corrected as shown below:

Column 1, line 55, after "to" insert ---- the ----.

Column 2, line 27, delete "respectively, detectors" and insert ---- respectively. Detectors ----.

Column 3, line 3, before "sheets" insert ---- the ----.

Column 3, line 9, after "receives" insert ---- the ----.

Column 3, line 10, delete "fo" and insert ---- of ----. Same line, delete "The swing" and insert ---- A swing ----.

Column 3, line 66, after "during" insert ---- the ----.

Column 4, line 3, after "pers" insert a comma ---- , ----.

Column 4, line 6, before "delivery" insert ---- endless ----.

UNITED STATES PATENT AND TRADEMARK OFFICE

CERTIFICATE OF CORRECTION

PATENT NO. : 4,448,121 Sheet 2 of 4

DATED : May 15, 1984

INVENTOR(S) : Uno, et al.

It is certified that error appears in the above-identified patent and that said Letters Patent is hereby corrected as shown below:

Column 4, line 10, before "printing" insert ---- rotary ----. Same line, after "35" insert ---- , and is ----.

Column 4, line 18, delete "upon" and insert ---- indicating ----.

Column 4, line 27, delete "gone" and insert ---- passed ----.

Column 4, line 28, delete "cause" and insert ---- causes ----.

Column 5, line 4, delete "input" and insert ---- output ----.

Column 5, line 15, before "signal" insert ---- the ----.

Column 5, line 33, delete "Sheets" and insert ---- The sheets ----.

Column 5, line 52, before "delivery" insert ---- endless ----.

Column 5, line 57, before "delivery" insert ---- endless ----.

Column 6, line 11, before "delivery" insert ---- endless ----.

Column 6, line 12, after "processor" insert ---- means ----.

Column 6, line 13, delete "36 and 39" and insert ---- $S_{36}$ and $S_{39}$ ----.

Column 6, line 35, after "$P_{12}$" insert a comma ---- , ----.

Column 6, line 42, after "12 and 13" insert a comma ---- , ----.

<u>In the Claims</u>

Column 7, line 18, after "input" insert ---- sheet feeding ----.

UNITED STATES PATENT AND TRADEMARK OFFICE

CERTIFICATE OF CORRECTION

PATENT NO. : 4,448,121

DATED : May 15, 1984

INVENTOR(S) : Uno, et al.

It is certified that error appears in the above-identified patent and that said Letters Patent is hereby corrected as shown below:

Column 7, line 28, after "output" insert ---- sheet feeding ----.

Column 7, line 35, before "printing" insert ---- rotary ----.

Column 7, line 51, after "said" insert ---- at least one ----.

Column 7, line 52, after "said" insert ---- at least one ----.

Column 7, line 55, after "said" first occurrence, insert ---- at least one ----.

Column 7, line 58, after "said" insert ---- automatic ----.

Column 7, line 67, delete "said" and insert ---- each of said two ----. Same line, delete "cylinder" and insert ---- cylinders ----.

Column 8, line 8, before "holding" insert ---- sheet ----.

Column 8, line 16, delete "defect" and insert ---- defects ----.

Column 8, line 35, after "input" insert ---- sheet feeding means ----.

Column 8, line 45, after "output" insert ---- sheet feeding means ----.

Column 8, line 47, delete "sheet" and insert ---- sheets ----.

UNITED STATES PATENT AND TRADEMARK OFFICE

CERTIFICATE OF CORRECTION

PATENT NO. : 4,448,121 Sheet 4 of 4

DATED : May 15, 1984

INVENTOR(S) : Uno, et al.

It is certified that error appears in the above-identified patent and that said Letters Patent is hereby corrected as shown below:

Column 8, line 53, after "said" insert ---- rotary ----.

Column 9, line 11, after "said" insert ---- automatic ----.

Column 9, line 22, after "wherein" insert ---- said ----.

Column 9, line 26, delete "releasably" and insert ---- releaseably ----.

Column 9, line 28, before "holding" insert ---- sheet ----.

In the Abstract

Line 9, after "inspection" insert -- cylinders --.

Signed and Sealed this

*Twenty-sixth* Day of *February 1985*

[SEAL]

*Attest:*

DONALD J. QUIGG

*Attesting Officer* *Acting Commissioner of Patents and Trademarks*